United States Patent [19]

Bratchell

[11] 4,038,355

[45] * July 26, 1977

[54] PRODUCTION METHOD AND MEANS FOR CONCRETE ARTICLES

[75] Inventor: Robert Lyndon Bratchell, Ottoway, Australia

[73] Assignee: Concrete Industries (Monier) Limited, Ottoway, Australia

[ * ] Notice: The portion of the term of this patent subsequent to July 26, 1994, has been disclaimed.

[21] Appl. No.: 522,934

[22] Filed: Nov. 11, 1974

Related U.S. Application Data

[63] Continuation-in-part of Ser. No. 295,938, Oct. 10, 1972, abandoned.

[30] Foreign Application Priority Data

Oct. 27, 1971 Australia ..... 6810/71

[51] Int. Cl.[2] ..... B28B 23/04

[52] U.S. Cl. ..... 264/157; 249/86; 264/228; 264/297; 264/336; 425/111

[58] Field of Search ..... 264/228, 334, 336, 297, 264/157; 425/111, 439; 249/86, 137

[56] References Cited

U.S. PATENT DOCUMENTS

| | | | |
|---|---|---|---|
| 3,190,607 | 6/1965 | Sonneville | 249/86 X |
| 3,577,610 | 5/1971 | Margolin | 425/439 X |
| 3,608,163 | 9/1971 | Harford | 425/111 X |
| 3,611,518 | 10/1971 | Glass | 425/439 |

*Primary Examiner*—Thomas P. Pavelko
*Attorney, Agent, or Firm*—Oldham & Oldham Co.

[57] ABSTRACT

A method of moulding concrete ties in a series of open ended multi-cavity moulds which are arranged to have corresponding cavities aligned, and comprises positioning reinforcing wires in the aligned cavities and straining the wires, positioning spacers between adjacent ends of adjacent moulds and between the wires, filling the moulds with wet concrete to surround the wires, removing the spacers after the concrete has set and releasing the tension on the wires, severing the wires between adjacent moulds, coupling a tilt frame to one side of a mould frame and a base frame, the tilt frame comprising a pivot having a longitudinal axis, and lifting the other side of the mould frame to thereby pivot the mould frame about the longitudinal axis, lowering the mould frame to invert it and discharging the ties from the inverted moulds.

6 Claims, 8 Drawing Figures

PRODUCTION METHOD AND MEANS FOR CONCRETE ARTICLES

This invention is a continuation-in-part of the invention described in the now lapsed U.S. application Ser. No. 295,938, filed Oct. 10, 1972 and relates to a production method and means for the moulding of concrete articles, and is specifically directed to a method of moulding concrete ties (sleepers) for railroad purposes.

BACKGROUND OF THE INVENTION

Concrete ties containing prestressed wires are in common use, but in order for them to be economically viable it is necessary for them to be produced at a very fast rate, and the most usual practice of producing concrete ties is to stretch out prestressing wires over a considerable length, the wires being contained in a series of aligned cavities of multi-cavity moulds, the concrete being poured into the moulds and allowed to set while the tension is retained on the rods. After the concrete has set the tension is released from the ends of the rods and the rods are cut between the molds and the ties are removed from the moulds.

Many proposals have been made for the production of concrete ties (sleepers) and other concrete articles. For example Barber in his U.S. Pat. Nos. 2,394,227 and 2,394,228 teaches formation of prestressed concrete sleepers where moulds may be aligned both end to end and side by side. Barber is primarily concerned with a single cavity mould. Glass U.S. Pat. No. (3,732,053) teaches the use of a pallet, with a tie in place, being inverted and held against downward movement while pressure is exerted through an opening in the pallet to eject the tie from the pallet. However the mould is rotated by being coupled to a rotary head in turn connected to a motor, but that arrangement is complex when large numbers of moulds are to be rotated. Dowsett (U.S. Pat. No. 2,397,728) teaches the aligning of a series of open ended moulds about tensioning wires and fitting end plates between the aligned moulds and about the wires. After the concrete has been cast and hardened in the moulds and about the wires, the end plates are removed to facilitate cutting of wires by torches. Stockmar (U.S. Pat. No. 2596052) teaches inversion of moulds to assist in release of the products therefrom, wherein the moulds are positioned against conveyor rollers and are then tilted along with the conveyor rollers to avoid any danger of the cast concrete products tumbling out of the moulds. As far as is known, the above is an accurate summary of the most relevant prior art.

Notwithstanding the above developments however, the method most commonly used in practice is to arrange the multi-cavity moulds on a base frame, pour the concrete, sever the wires between the moulds, and remove the products from the moulds. Most of the operations are relatively simple, but several difficulties are encountered. Firstly if the moulds are of the type having closed ends, the adhesion between a product and the walls of the moulds becomes very great unless there is a large "draw angle," and this is not permitted in most instances with concrete ties. Secondly, some hoisting arrangement is usually employed and this usually requires the use of overhead tracks. Thirdly, the reinforcing wires are frequently positioned by means of interengaging plates or plates having apertures therein, and these are slow to assemble and difficult to release. However although the abovementioned difficulties add considerably to the expense, the most series difficulty of all is that of discharging the cast ties from the moulds having regard to the fact that the moulds move longitudinally.

If the number of ties to be cast in one run of a hopper is considerable (say for example 500), and the number of cavities in a multi-cavity mould is relatively small (say for example 5) then there is a large number of spaces between adjacent moulds, (in this example 99 spaces). Before the spacer bars can be repositioned, these spaces must be enlarged for insertion of spacer bars between the mould ends, this being achieved by moving the moulds along the base frame. The spaces contract upon recovery of the tensioned wires when tension is released after the concrete has set and the spacers removed. These two movements combine, and are additive over the bed length, so that the movement of the furthermost mould is likely to exceed the distance between supports for a continuous hinge, if used. Furthermore, a fixed hinge bar extending along one side of the moulds interferes with spacer bar withdrawal from that side, and it is often inconvenient to withdraw from the other side. It is believed that this is the reason that commercially, most moulded ties are hoisted from the mould cavities and transported away from the moulds by an overhead hoist. The excessive longitudinal movement makes it difficult to achieve an inversion of the moulds owing to interference by the hinge bar supports, and an object of this invention is to provide means whereby the moulds may be readily inverted about longitudinal axes even though they need to move along the base frame.

BRIEF SUMMARY OF THE INVENTION

Briefly the invention may be summarized as including the steps of moulding concrete ties, firstly positioning the mould frames on a base frame so that the cavities are in alignment with one another, secondly placing wires in the aligned cavities and tensioning the wires, then putting spacers between the ends of adjacent moulds and between the reinforcing wires so as to correctly position the wires within the moulds, then discharging the wet mix of concrete into the moulds, allowing the concrete to initially set, removing the spacers, allowing the concrete to cure, releasing the tension on the wires and severing the wires between adjacent moulds, and coupling a tilt frame to one side of one of the mould frames and to the base frame, the tilt frame comprising pivot means having a longitudinal axis, lifting the other side of the mould frame to thereby pivot the mould about that longitudinal axis, lowering the mould to invert it, and discharging the ties from the inverted moulds.

By incorporating a tilt frame which is separate from but coupled to the base frame and the mould frame, it does not matter that the mould frame moves with respect to the base frame in setting up, and after release of wire tension. This then enables the moulded ties to be discharged in the simplest possible manner, that is by inversion of the moulds, and reduces what has proved to be one of the most expensive steps in previously proposed methods of producing moulded concrete ties. On one commercial plant using this method of moulding concrete ties, the time has been reduced to 15 man minutes per tie (including all overhead labour). This is believed to be faster than any other previously proposed method.

The invention has as a further object a means whereby the spacers between the open ended moulds can be quickly and easily removed, and before the next pour, quickly and easily replaced, and the method further according to the invention provides positioning flat barlike spacers between wires to arrange the wires in horizontal rows and also to function as closure members at the ends of the open ended moulds, and, after moulding of the concrete ties, withdrawing the spacers in a lateral direction. Still further, the invention includes a method of separating the wires into vertical rows by having some but not all of the spacers between the mould ends constituted by plates having vertically extending slots, and urging the plates downwardly after moulding of the concrete ties to thereby remove those plates from between the mould ends.

BRIEF DESCRIPTION OF THE DRAWINGS

An embodiment of the invention is described hereunder in some detail with reference to and as illustrated in the accompanying drawings in which.

Figure 1:
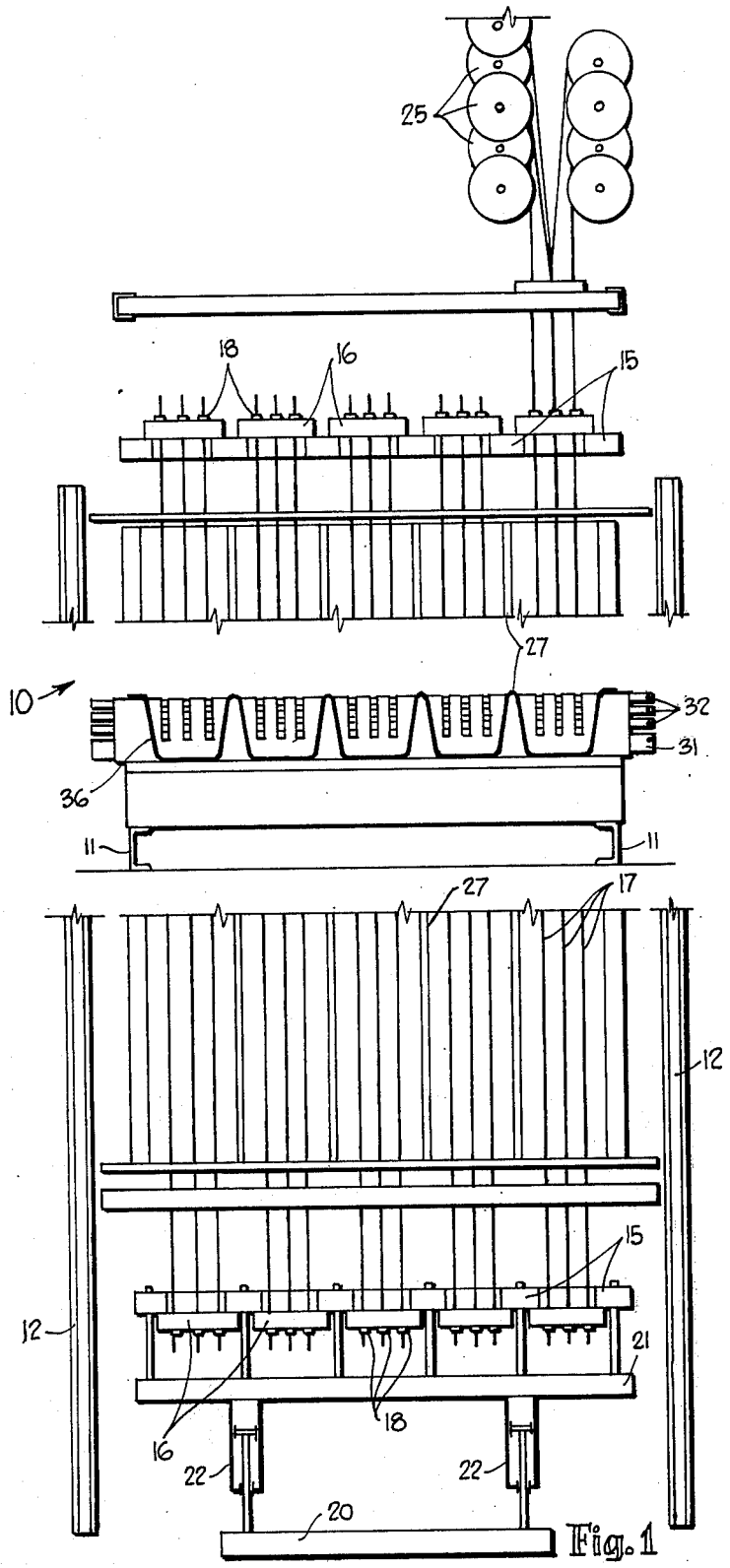
FIG. 1 is a partly broken plan view which illustrates a bay in which concrete ties are moulded.

In this embodiment a moulding bay 10 is provided with a base frame 11 (formed from two channels secured to a bed), the base frame 11 being flanked on each side by a respective rail 12.

At one end of the moulding bay 10 there is provided a fixed bolster 14 which comprises a plurality of upstanding bolster plates 15, and between these plates there are disposed anchor blocks 16 which abut the plates 15 and themselves anchor reinforcing wires 17 by means of collets 18. At the other end of the base 10 there is provided a fixed beam 20 which is coupled to a moving bolster 21 by means of hydraulic cylinders 22, the moving bolster 21 also having upstanding plates 15 which are coupled by means of tension links 23, and these plates 15 support blocks 16 as at the other end, and the other ends of the wires 17 are also attached by collets 18.

The wires 17 are run off reels which are designated 25 and positioned at the fixed bolster end of the bay 10.

The base frame 11 supports a plurality of mould frames designated 26 (FIG. 6), each mould frame 26 comprising an open ended multi-cavity mould 27, each mould 27 having five cavities 28 therein which extend longitudinally, are parallel to one another and spaced transversely, and are of such shape as to form the concrete ties designated 29.

Figure 2:
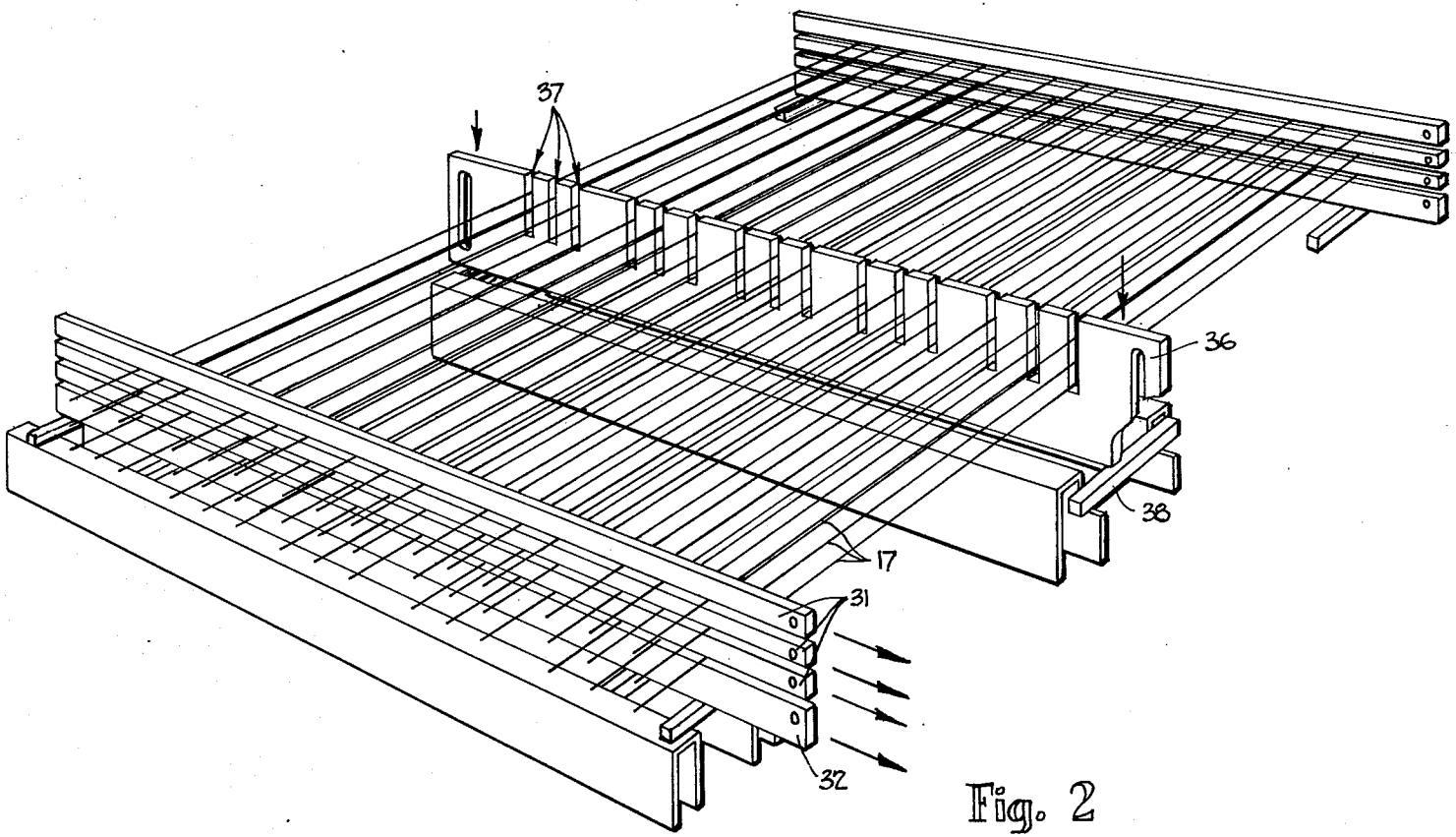
FIG. 2 illustrates the configuration of wires as separated by the flat bar-like spacers and the vertically movable spacers which contain vertically extending slots.
Figure 3:
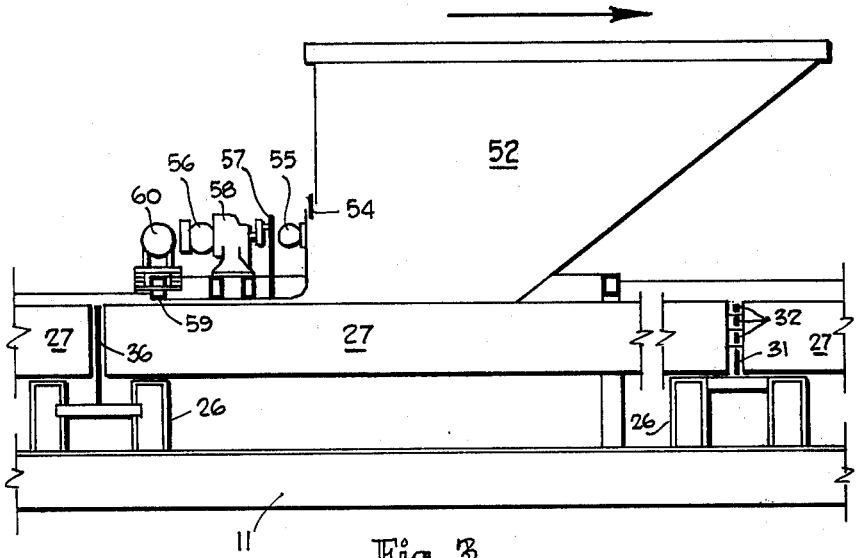
FIG. 3 illustrates the step of transporting a wet mix of concrete over the moulds whilst simultaneously discharging the concrete into the moulds.
Figure 4:
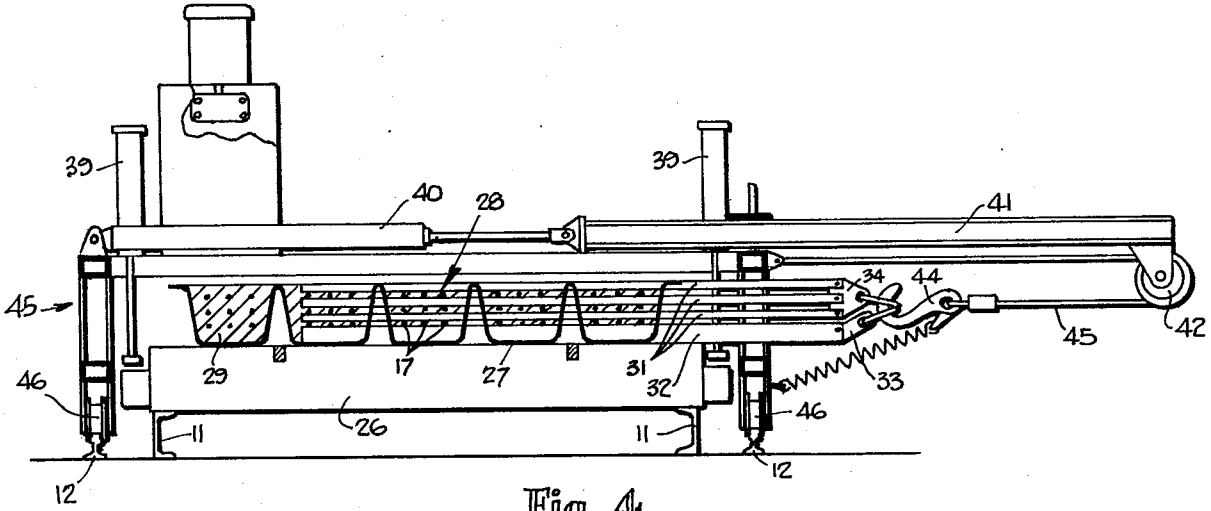
FIG. 4 illustrates the step of removing the spacers after the concrete has set.

Each mould 27 is an open ended mould, and is closed at its ends by spacers. Some of the spacers which are designated 31 are long bar-like horizontally disposed members which are withdrawable in a lateral direction as shown in FIG. 2 by means of apertures 32 therein (enagageable by brackets 33 and 34 as illustrated in FIG. 4) while other spacers designated 36 in FIGS. 1 and 2 are provided with vertical slots 37 and are supported at their ends by bars 38 which are removable to allow the spacers 36 to be driven downwardly by hydraulic cylinders 39 (FIG. 4), the spacers 31 being withdrawn by a hydraulic cylinder 40 actuating a boom 41 having on it a pulley wheel 42 over which passes a cable 43 coupled to brackets 33 and 34 by a hook 44. This equipment is carried on a machine generally designated 45 supported from the rails 12 by wheels 46 so that it can be moved along the bay and withdraw the spacers one after another.

Initial positioning of the spacers and wires is effected by firstly separating the multi-cavity moulds to increase the space between adjacent ends, then supporting the lowermost of the horizontal bar-like spacers 31 between adjacent moulds, then running out the wires from the reels 25 to rest upon said lowermost spacers 31, tensioning the wires, interposing the remaining of the spacers 31 to thereby form the wires into horizontal rows, and lifting the spacers 36 to form the wires also into vertical rows. The tension is applied by actuation of cylinders 22 which move the movable bolster 21 in a direction away from the fixed bolster 15.

After the spacers have been positioned and the wires have been tensioned (or if desired before the wires are tensioned) the moulds are moved towards one another by sliding along the base frame 11. To guide the moulds over the base frame 11, the mould frames 26 are provided with depending guide shoes 15 as shown best in FIG. 6. When the moulds have been moved as close together as possible, the spacers 31 and 36 function in a secondary capacity, namely that of closing the ends of the open ended cavities of the moulds.

After the wires have been tensioned and the cavities have been closed, a hopper designated 52 is moved along the bay, the hopper being supported by wheels (not shown) from the rails 12. The hopper is provided with a trailing screed plate 53 coupled to the hopper by means of a flexible coupling 54, the hopper having on it a vibrator 55 and the screed plate having on it a hydraulic motor 56 which drives an oscillating screed bar 57 through a gear box 58. There is also provided a vibrating screed bar 59 at the trailing end of the screed plate 53, and vibrated by the vibrator 60. The hopper 52 is continuously filled with wet concrete which is discharged into the cavities of the multi-cavity moulds as the hopper traverses from one end of the bay to the other.

After the concrete has initially set the spacers are removed as described above in the description which related to FIG. 4 of the drawings. The concrete is then cured by the application of steam, a flexible sheet being thrown over the wet concrete to entrap the steam. The movable bolster 21 is reversed in its direction towards the fixed bolster 14 so that the tension in the wires is relaxed. This results in still further movement of the moulds towards one another.

Figure 5:
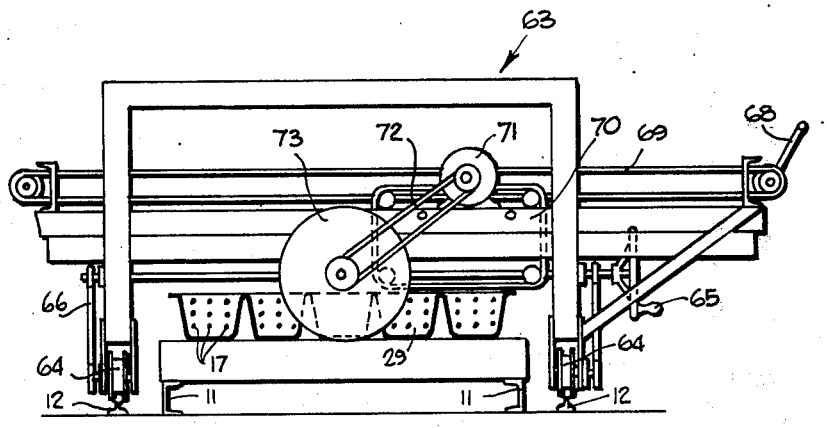
FIG. 5 illustrates the step of severing the reinforcing wires between adjacent moulds.

Referring now to FIG. 5, after the tension has been relaxed to the wires 17 a machine designated generally 63 is moved along the bay from one space between adjacent moulds to the next, the machine being carried on wheels 64 which engage the rails 12. The machine is moved by means of a hand wheel 65 coupled by chains 66 to the wheel 64. (In some embodiments, the hand wheel 65 may be replaced by an electric or hydraulic motor). A handle 68 is coupled by a further chain 69 to a cross head 70 which carries on it a motor 71 coupled by a belt drive 72 to an abrasive cutting wheel 73 which severs the wires in the spaces between adjacent moulds as the cross head 70 is moved transversely across the moulds.

Figure 6:
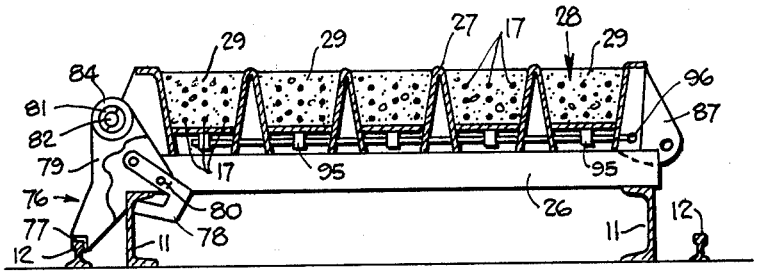
FIG. 6 illustrates the step of coupling a tilt frame to one side of one of the mould frames and to the base frame.
Figure 7:
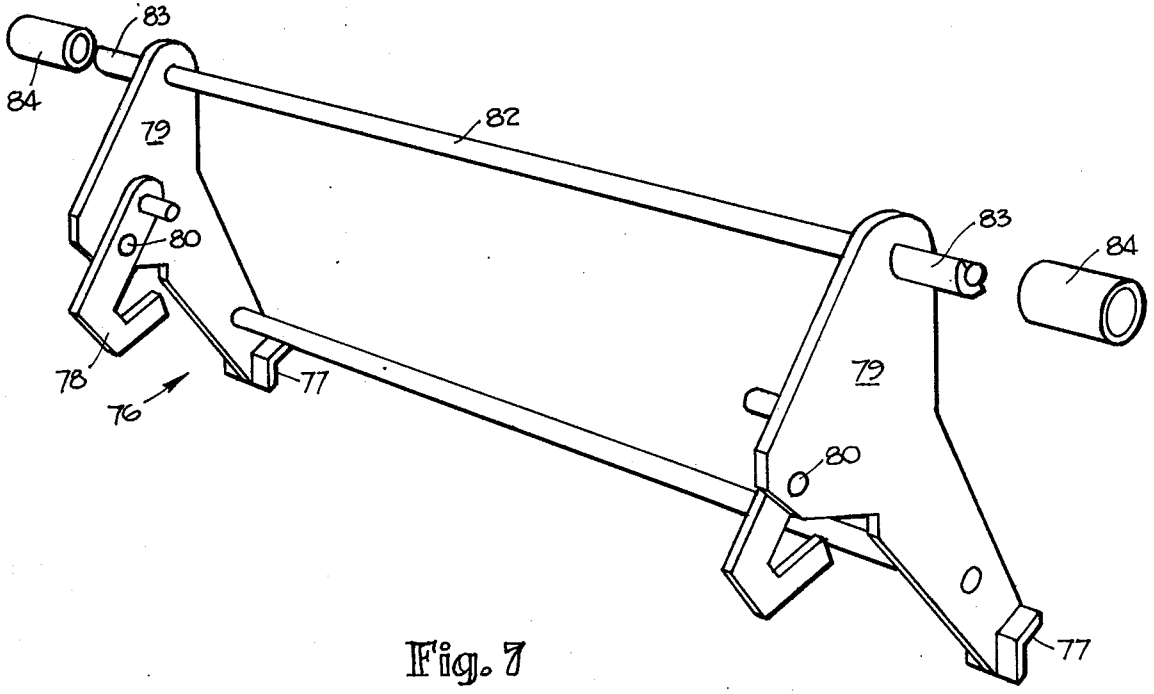
FIG. 7 is a perspective view of the tilt frame.

After the wires have been severed, the machine 63 is removed from the rails 12 (or run to one end of the bay). The mould frame 26 of each mould is then coupled to the base frame 11 by means of a tilt frame designated 76 in FIGS. 6 and 7. The tilt frame 76 is provided with feet 77 which rest upon a rail 12, and is provided with a pair of hooks 78 each pivoted to a side plate 79 and which engage beneath the upper flange of one of the channels of the base frame 11 as illustrated in FIG. 6. By careful positioning of the pivots 80 of the respective hooks 78, the load applied to the hooks 78 by subsequent lifting is resisted by the said upper flange. Each mould frame 26 is provided with a pair of half sleeves designated 81, and a bar 82 of the tilt frame 76 is provided also with a pair of half sleeves designated 83, the half sleeves abutting one another as shown in FIG. 6 when the tilt frame is in position and being retained together by means of outer sleeves 84. The outer sleeves 84 then enable the mould frame 26 to pivot about the axis of the bar 82 when the other end is lifted.

Figure 8:
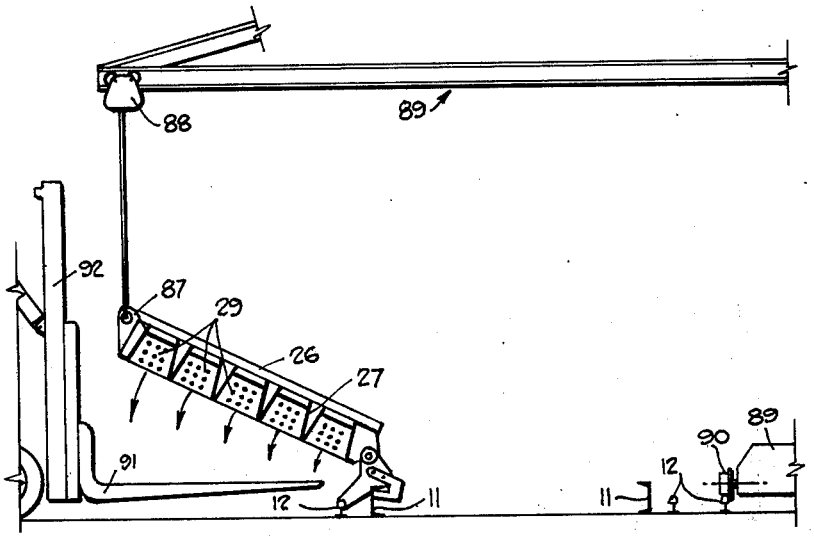
FIG. 8 illustrates the step of lifting the other side of the mould frame to thereby pivot the mould frame and invert it.

The other side of the mould frame 26 is provided with a lifting lug designated 87, and this is lifted by a hoist 88 (FIG. 8) of a crane 89 only partly shown in FIG. 8, the crane 89 being supported from adjacent rails 12 by wheels 90.

As the mould frame 26 is lifted, the hoist 88 is extended outwardly so that the mould frame can then be lowered to invert it. As shown in FIG. 8, inversion takes place over the forks 91 of a fork lift truck 92. However before the moulds are thus lifted and inverted, steam is applied to the moulds for a short period of time, this expanding the metal more than the concrete (which has insufficient time to heat) and some adhesion is broken. Notwithstanding this, if there is a relatively small draw angle in the moulds (as shown) some difficulty will be encountered in releasing the ties from the moulds. In this embodiment release is achieved by shaking the ties up and down with the forks 91 of the truck 92, but other means can be utilised for this purpose. For example the other means can include a vibrator carried on the forks 91 and engaged by the mould 27, or the forks 91 may be provided with blocks which support the moulds as they are lowered, but reversing the truck allows the moulds to drop from the blocks onto the forks. These alternatives are not illustrated.

In certain cases it is necessary for ties to be provided with shoulders for the retention of rails, such shoulders are designated 95 in FIG. 6, and these are retained in position by means of a bar 96 which is withdrawn most easily when the moulds have been inverted. The bar 96 also ensures that the ties do not inadvertently tumble out of the moulds before the moulds are fully inverted, such a tumbling action being most undesirable since the concrete is usually in its "green" state when being discharged.

A brief consideration of the above embodiment will indicate that the invention makes possible a rapid and easy release of ties from moulds. It will be appreciated that the moulds can be positioned longitudinally in any position along the base frame 11 and yet the tilt frame will function without interference from supporting brackets and the like.

I claim:

1. A method of moulding concrete ties which comprises the steps:

positioning a plurality of mould frames on a longitudinally extending base frame, each mould frame comprising an open ended multicavity mould, the cavities of which are of shape for the forming of the concrete ties, and having thereon engaging members which engage the sides of the base frame and thereby align corresponding cavities of the mould frames, positioning the lowermost of a first series of transversely extending spacers between adjacent ends of some of the axially adjacent moulds, positioning a series of reinforcing wires in the aligned cavities in parallel spaced relationship with one another and on said lowermost of the series of spacers, positioning the remainder of the first series of spacers also between adjacent ends of the said some of the adjacent moulds and in a horizontal direction between the reinforcing wires to separate the wires into horizontal rows, and positioning a second series of spacers between adjacent ends of the remaining adjacent moulds by movement in a vertical direction to engage the wires and separate them into vertical rows, securing the ends of the reinforcing wires to anchor means at respective ends of said line of cavities, and moving one of said anchor means away from the other to thereby strain said wires, mixing Portland cement, aggregate, sand and water to form a wet mix of concrete, transporting the wet mix of concrete over the moulds while simultaneously discharging said concrete into the moulds to thus fill the moulds and surround the reinforcing wires with concrete, removing the spacers after the concrete has set but before it cures, allowing the concrete to cure, and then releasing the tension on the wires, severing the reinforcing wires between adjacent said moulds, coupling a tilt frame to one side of one of said mould frames and a corresponding side of said base frame while the mould frames remain on the base frame, said tilt frame comprising pivot means having a longitudinal axis, lifting the other side of said mould frame to thereby pivot the mould frame about said longitudinal axis and then lowering the mould frame to invert it beyond said base frame side, and discharging said ties from the inverted moulds.

2. A method of moulding concrete ties according to claim 1 wherein some but not all said spacers are horizontal flat bar-like spacers and said positioning of reinforcing wires is effected by positioning the lowermost of said bar-like spacers in some but not all of the spaces between adjacent ends of adjacent moulds.

3. A method of moulding concrete ties according to claim 1 wherein each mould frame comprises a pair of spaced half sleeves, said tilt frame also comprises a pair of similarly spaced half sleeves co-operable with the mould frame half sleeves, and said coupling of the tilt frame to the said mould frame comprises abutting respective said co-operable half sleeves, and positioning an outer sleeve over each said pair of abutted half sleeves.

4. A method of moulding concrete ties according to claim 3 wherein said base frame comprises longitudinally extending channels, rails flanking respective sides of the base frame, said tilt frame comprising hooks and feet, said coupling of the base frame comprising engaging the feet on said rails and the hooks to the flange of said channel.

5. A method of moulding concrete ties according to claim 1 comprising the further step of moving said one of said anchor means towards said other to thereby release tension in said reinforcing wires after the concrete has set but before said severing.

6. A method of moulding concrete ties according to claim 1 further comprising providing said ties with shoulders extending beyond a bottom portion of the moulds, inserting a bar through said shoulders externally of said mould, and withdrawing the bar after said inverting of said mould frame but before said discharging of the ties.

* * * * *